United States Patent [19]

Haley

[11] 4,182,327

[45] Jan. 8, 1980

[54] APPARATUS FOR ADMINISTERING DRUGS TO ANIMALS

[76] Inventor: Henry C. Haley, P.O. Box 55, Calumet, Okla. 73014

[21] Appl. No.: 874,137

[22] Filed: Feb. 1, 1978

[51] Int. Cl.[2] ..... A61M 5/00

[52] U.S. Cl. ..... 128/215; 128/DIG. 11; 273/106.5 D

[58] Field of Search ..... 128/DIG. 11, 215, 218 R; 273/106.5 R, 106.5 D

[56] References Cited

U.S. PATENT DOCUMENTS

| | | | |
|---|---|---|---|
| 2,995,373 | 8/1961 | Cox | 128/DIG. 11 |
| 3,006,649 | 10/1961 | Gesick et al. | 128/DIG. 11 |
| 3,042,406 | 7/1962 | Gregory | 128/DIG. 11 |

*Primary Examiner*—John D. Yasko

[57] ABSTRACT

Apparatus for administering drugs to animals is provided comprised of bow means for propelling an arrow, an arrow having drug dispensing means attached to the forward end thereof and a reel having a length of cord wound thereon attached to the bow means. The free end of the cord is attached to the arrow whereby the arrow can be retrieved after being propelled by reeling in the cord.

5 Claims, 6 Drawing Figures

APPARATUS FOR ADMINISTERING DRUGS TO ANIMALS

BACKGROUND OF THE INVENTION

1. Field of the Invention

The present invention relates generally to apparatus for administering drugs to animals, and more particularly, but not by way of limitation, to apparatus of the bow and arrow type for injecting drugs into animals from a remote location.

2. Description of the Prior Art

The administration of drugs to animals such as cattle to prevent and/or cure disease has become commonplace. For example, cattle commonly suffer from a disease similar to pneumonia known as "shipping fever," and when a shipment of cattle is received it is often necessary or desirable to inject the cattle with antibiotics and other drugs to insure that they remain healthy. In addition, drugs are administered to cattle and other livestock on a periodic basis to prevent and/or cure various diseases to which the livestock are susceptible.

Heretofore, in order to administer drugs to livestock, it has been necessary to individually capture each animal or to herd the livestock into a pen followed by running each through a squeeze chute or similar apparatus wherein they are held while being injected with the drugs.

By the present invention, an apparatus for administering drugs to animals is provided which obviates the necessity of capturing, penning and/or handling the animals individually.

SUMMARY OF THE INVENTION

An apparatus for administering drugs to animals which comprises a bow means for propelling an arrow, an arrow having a forward end and rearward end, a reel having a length of cord wound thereon attached to said bow means, the free end of the cord being attached to the arrow, and drug dispensing means attached to the forward end of the arrow. The drug dispensing means are comprised of a hollow tube having a forward end, a rearward end attached to the arrow, a plunger sealingly disposed within the tube, means for moving the plunger to the rearward end of the tube attached thereto, means for constantly urging the plunger towards the forward end of the tube attached thereto, a hypodermic needle attached to the forward end of the tube and impact valve means attached to the hypodermic needle and to the tube for closing the forward end of the tube until the needle strikes an animal.

It is, therefore, a general object of the present invention to provide an apparatus for administering drugs to animals.

A further object of the present invention is the provision of an apparatus for dispensing drugs to animals which obviates the necessity of penning the animals and/or individually handling the animals.

Yet a further object of the present invention is the provision of an apparatus for administering drugs to animals which can be utilized from locations remote from the animals and which does not spook other nearby animals.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
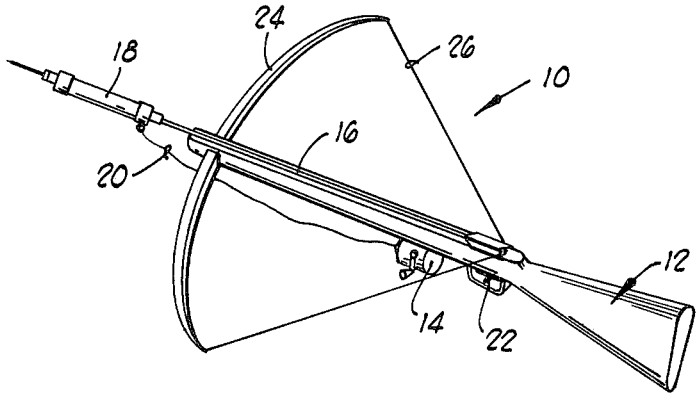
FIG. 1 is a perspective view of the apparatus of the present invention.

Referring now to the drawings, and particularly to FIG. 1, the apparatus of the present invention is illustrated and generally designated by the numeral 10. The apparatus 10 is comprised of bow means for propelling an arrow, preferably a conventional crossbow apparatus 12, having a conventional reel 14 with a length of cord wound thereon attached thereto. An arrow 16 is provided having a drug dispensing means 18 attached to the forward end thereof, and the free end 20 of the cord wound on the reel 14 is attached to the arrow 16 or drug dispensing means 18. As will be understood, the crossbow 12 includes a trigger mechanism 22 and a bow 24 having a bow string 26 attached to the ends thereof whereby when the bow 24 is bent and the bow string 26 placed on the trigger mechanism 22, it is retained by the trigger mechanism 22 until the trigger is activated. In operation of the apparatus 10, the arrow 16 is placed upon the crossbow 12 with the rearward end thereof engaged by the bow string 26. Upon activation of the trigger mechanism 22, the bow string 26 is released causing the arrow 16 and the drug dispensing means 18 attached thereto to be propelled from the crossbow 12 towards a target at which it is aimed.

In using the apparatus 10 for administering drugs to animals, the drug dispensing means 18, which will be described in detail hereinbelow, is filled with a drug to be injected into an animal. The arrow 16 and drug dispensing means 18 are then propelled by the crossbow apparatus 12, and upon striking an animal, the drug within the drug dispensing means 18 is injected thereinto. As the arrow 16 and drug dispensing means 18 are propelled away from the crossbow apparatus 12, the cord wound on the reel 14 is unwound therefrom. The arrow 16 and drug dispensing means 18 are retrieved by rewinding the cord on the reel 14 whereupon the process is repeated to inject another animal.

Figure 2:
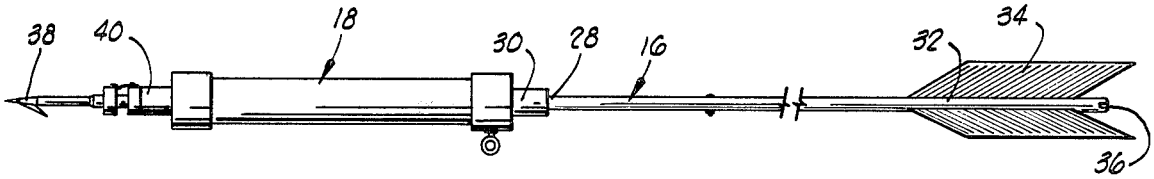
FIG. 2 is a side view of an arrow having drug dispensing means attached thereto in accordance with the present invention.

As shown best in FIG. 2, the forward end 28 of the arrow 16 is attached to the rearward end 30 of the drug dispensing means 18. The rearward end portion 32 of the arrow 16 includes feathers 4 attached thereto in a conventional manner and a groove 36 is formed in the rearward end of the arrow for engaging the bow string of the crossbow apparatus 12. The drug dispensing means 18 includes a hypodermic needle 38 attached to the forward end 40 thereof which upon striking an animal penetrates the skin of the animal so that a drug contained in the drug dispensing means 18 is injected into the animal.

Referring to FIGS. 3A, 3B, 4A and 4B, the drug dispensing means 18 is illustrated in detail. The drug dispensing means 18 is comprised of a hollow tube 42 having a threaded forward end 44 and a threaded rearward end 46. A hypodermic needle-impact valve assembly, generally designated by the numeral 48 is threadedly connected to the forward end 44 of the tube 42, and a connector 50 is threadedly connected to the rearward end 46 of the tube 42 and to the threaded forward end 28 of the arrow 16. A plunger, generally designated by the numeral 52, is sealingly disposed within the tube 42. The plunger 52 includes a cylindrical piston member 54 formed of rubber or other elastic material which sealingly engages the inside surfaces of the tube 42, but which can be moved laterally therewithin. A rod 56 is attached to the piston 54 which extends longitudinally within the tube 42 through the connector 50 and into a hollow forward end portion 58 of the arrow 16. A spring 60 is disposed within the hollow portion 58 of the arrow 16, the forward end of which is attached to a spring button 62 slidably disposed within the hollow portion 58 of the arrow 16. The spring button 62 contacts the rearward end portion 64 of the rod 56 and constantly urges the rod 56 and the piston member 54 attached thereto forwardly. A removable guide member 66 is threadedly attached to the interior of the connecting member 50 through which the rod 56 passes and which maintains the rod 56 in a coaxial position with the tube 42. A plurality of opposing apertures 63 are disposed in spaced relationship in the arrow 16 at the rearward end of the hollow portion 58 thereof and a pin 61 is positioned through a pair of the opposing apertures 63 for retaining the rearward end of the spring 60 thereagainst. As will be understood, the pin 61 can be positioned in a selected pair of the apertures 63 to increase or decrease the force exerted on the rod 56 by the spring 60.

The hypodermic needle-impact valve assembly 48 includes a hollow closure member 68 having an enlarged rearward portion 70 threadedly connected to the forward end 44 of the tube 42, and an elongated forward portion 72 of reduced diameter which is threaded internally. A valve seat member 74 having a longitudinal bore 76 disposed therein is connected within the interior of the closure member 68. The valve seat member 74 includes an enlarged end portion 78 which extends within the interior of the enlarged portion 70 of the closure member 78 and which includes an annular seating surface 80 at the rearward end thereof. Preferably, the annular seating surface 80 is recessed in the end of the enlarged portion 78 of the member 74. An annular groove 82 can be disposed in the seating surface 80 for containing a conventional O-ring seal member 84.

A guide member 86 including a longitudinal bore 88 is threadedly connected to the interior of the forward portion 72 of the closure member 68 at the forward end thereof, and an elongated hollow shaft 90 having a forward end 92 and a rearward end 94 is disposed within and extends through the bores 76 and 88 of the valve seat member 74 and guide member 86 respectively. An enlarged valve member 96 is attached to the end 94 of the shaft 90 which includes an annular seating surface 98 for matingly and sealingly engaging the annular seating surface 80 of the valve seat member 74. As an alternative to the groove 82 and O-ring seal member 84, the seating surface 98 of the valve member 96 can be coated with an elastic material for providing a seal between it and the sealing surface 80 of the member 74. A plurality of ports 100 are disposed in the rearward end portion of the shaft 90 adjacent the valve member 96 for providing communication between the interiors of the tube 42 and the shaft 90.

A stop member 102 is attached to the forward end portion of the shaft 90, and the forward end 92 of the shaft 90 is sealingly connected to the hollow hypodermic needle 38. The forward end portion of the hypodermic needle 38 is sharpened and includes one or more ports 106 which communicate with the interior thereof. A barb 108 is attached to the forward end portion of the hypodermic needle 38. A clip 109 is attached to the guide member 86 and positioned to coact with the stop member 102 whereby the stop member 102 is retained when moved to a position adjacent the guide member 86.

Figure 3A:
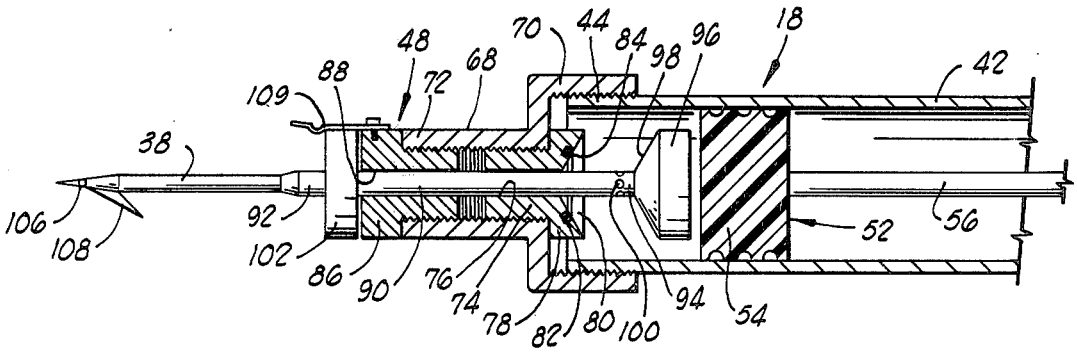
FIG. 3A is an enlarged partial cross-sectional view of the forward portion of the drug dispensing means with the impact valve means thereof in an open position and the plunger thereof moved forwardly.
Figure 3B:
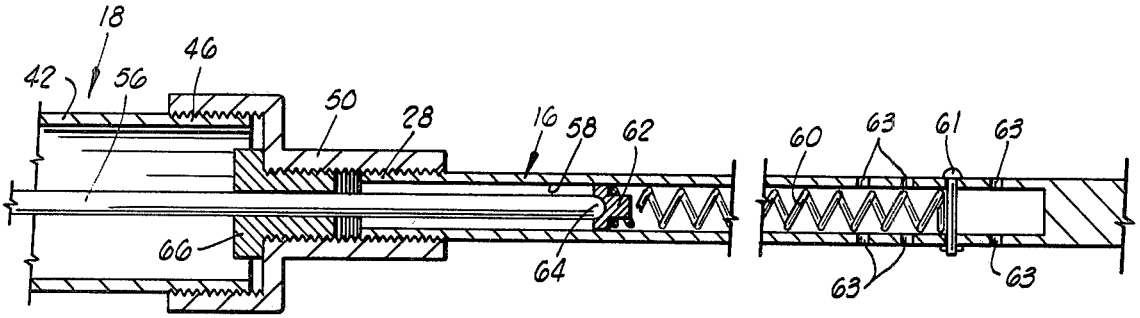
FIG. 3B is an enlarged partial cross-sectional view of the rearward portion of the drug dispensing means of FIG. 3A.

In operation of the drug dispensing apparatus 18, it is removed from the arrow 16 by disconnecting the connecting member 60 from the rearward end 46 of the tube 42. The shaft 90 of the assembly 48 is moved rearwardly whereby the stop member 102 is positioned adjacent the forward end of the guide member 86 and the valve 96 and seating surface 98 thereof are moved away from the seating surface 80 of the valve seat member 78 exposing the ports 100 to the interior of the tube 42 as illustrated in FIG. 3A. When the shaft 90 is in the rearward position, communication is provided between the interior of the tube 42 and the exterior of the hypodermic needle 38 by way of the ports 100, the interior of the shaft 90, the interior of the hypodermic needle 38 and the ports 106 in the hypodermic needle 38.

Figure 4A:
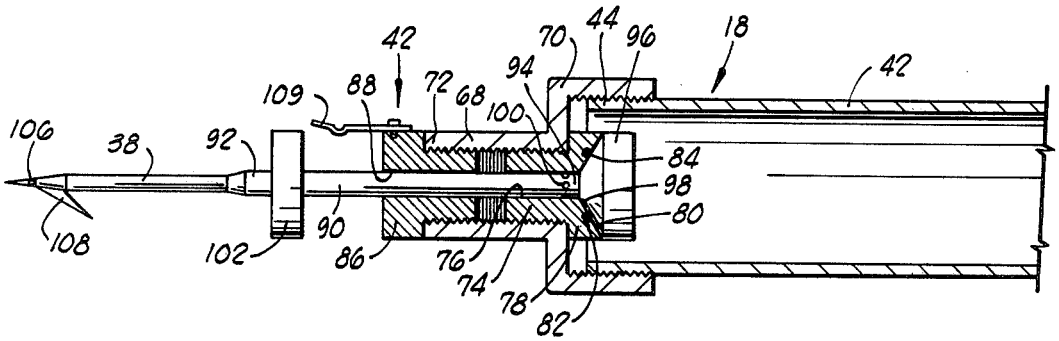
FIG. 4A is an enlarged partial cross-sectional view of the forward portion of the drug dispensing means with the impact valve means thereof in the closed position and the plunger thereof moved rearwardly.

The ports 106 in the hypodermic needle 38 are next positioned beneath the surface of a body of a drug in a conventional manner and the plunger 52 is moved rearwardly within the tube 42. That is, the end 64 of the rod 56 is grasped and moved rearwardly which moves the piston member 54 rearwardly and causes the drug to be drawn into the interior of the tube 42 by way of the hypodermic needle 38, the shaft 90 and the ports 100 disposed therein. When a desired quantity of drug has been drawn into the tube 42, the shaft 90 is moved forwardly whereby the valve member 96 and the annular seating surface 98 thereof are positioned in mated engagement with the seating surface 80 of the valve seat member 78 as shown in FIG. 4A, whereby a seal is provided between the interior of the tube 42 and the ports 100 in the shaft 90. As will be understood by those skilled in the art, prior to moving the shaft 90 to the forward position and thereby terminating the communication between the interior of the tube 42 and the ports 106 of the hypodermic needle 38, air is removed therefrom by holding the drug dispensing means 18 upright while moving the plunger 52 forwardly within the tube 42 a required distance. The rod 56 can include graduations (not shown) marked thereon for indicating the quantity of drug contained within the tube 42.

Figure 4B:
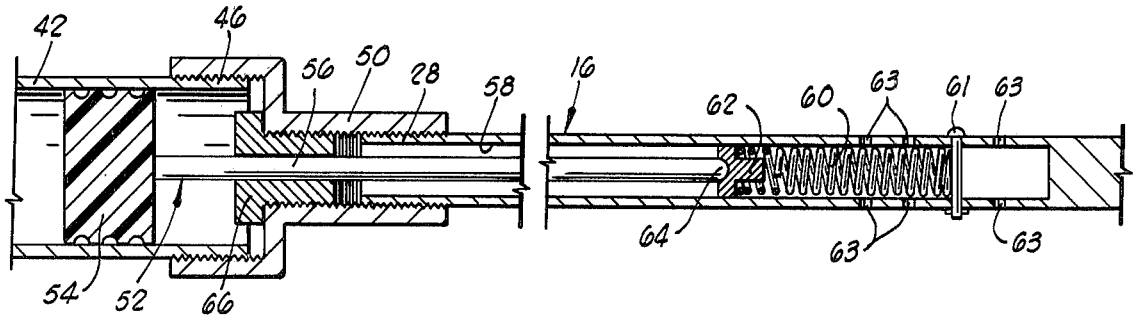
FIG. 4B is an enlarged partial cross-sectional view of the rearward portion of the drug dispensing means of FIG. 4A.

Once the desired quantity of drug has been drawn into the tube 42 and the shaft 90 moved to its forward position, the rearward end 64 of the rod 56 is inserted through the guide member 66 into the hollow portion 58 of the arrow 16 whereby the spring 60 is compressed as shown in FIG. 4B. The connecting member 50 is then threadedly connected to the rearward end 46 of the tube 42. As will be understood, the compressed spring 60 constantly urges the plunger 52 forwardly within the tube 42, but is prevented from moving the plunger 52 by the incompressible drug within the tube 42 so long as the shaft 90 is in the forward position and communication between the interior of the tube 42 and ports 100 prevented.

Once the drug dispensing means 18 has been loaded with a drug as described above, the arrow 16 and and drug dispensing means 18 are propelled by the crossbow apparatus 12 towards an animal to which the drug is to be administered. When the hypodermic needle 38 of the drug dispensing means 18 strikes an animal, it pierces the animal's skin and the forward end of the hypodermic needle 38 is retained therewithin by the barb 108 attached thereto. Simultaneously, the impact of the hypodermic needle 38 with the animal causes the shaft 90 to be moved rearwardly with respect to the tube 42 whereby the seating surface 98 of the valve member 96 is moved away from the seating surface 80 of the valve seat member 78 and communication between the interior of the tube 42 and the ports 106 of the hypodermic needle 38 is established by way of the ports 100 in the shaft 90. The rearward movement of the shaft 90 stops when the stop member 102 contacts the guide member 86 and is retained in that position by the clip 109. Once communication between the tube 42 and shaft 90 is established, the plunger 52 is moved forwardly within the tube 42 by the spring 60 which in turn causes the drug contained within the tube 42 to be forced out of the tube 42 by way of the ports 100, the interior of the shaft 90 and the hypodermic needle 38, and the drug to be injected subcutaneously in the animal. Once the drug has been injected, the arrow 16 and drug dispensing means 18 are retrieved by rewinding the cord connected thereto on the reel 14.

Thus, the present invention is well adapted to carry out the objects and attain the ends and advantages mentioned as well as those inherent therein. While presently preferred embodiments of the invention have been described for purposes of this disclosure, numerous changes in the construction and arrangement of parts will suggest themselves to those skilled in the art which are encompassed within the spirit of this invention as defined by the appended claims.

What is claimed is:

1. An apparatus for administering drugs to animals which comprises:

bow means for propelling an arrow;

an arrow having a forward end and a rearward end;

a reel having a length of cord wound thereon attached to said bow means, the free end of said cord being attached to said arrow whereby said arrow can be retrieved after being propelled by reeling in said cord; and drug dispensing means attached to the forward end of said arrow comprising:

a hollow tube having a forward end and a rearward end, the rearward end of said tube being attached to said arrow;

a plunger sealingly disposed within said tube;

means for moving said plunger to the rearward end of said tube attached thereto;

means for constantly urging said plunger towards the forward end of said tube attached thereto;

a hypodermic needle attached to the forward end of said tube; and impact valve means attached to said hypodermic needle and to said tube for closing the forward end of said tube until said needle strikes an animal whereupon said valve means are opened and a drug contained within said tube is injected into said animal by way of said hypodermic needle.

2. The apparatus of claim 1 wherein said bow means is a crossbow.

3. The apparatus of claim 1 wherein said impact valve means are comprised of:

a closure member attached to the forward end of said tube having a longitudinal bore disposed therein;

an annular valve seat attached within said closure member at the rearward end of said bore;

an elongated hollow shaft having a forward end and a rearward end disposed through said bore, the forward end of said shaft being connected to said hypodermic needle and the rearward end thereof including one or more ports disposed therein communicating with the hollow interior of said shaft; and an annular valve attached to the rearward end of said shaft within said closure member for matingly engaging said valve seat whereby when said shaft and hypodermic needle are moved to a forward position, said valve is engaged with said valve seat and communication between said ports in said shaft and the interior of said closure member is shut off, and when said tube and hypodermic needle are moved rearwardly, said valve is moved away from said valve seat whereby said hypodermic needle is communicated with the interior of said closure member by way of said ports in said hollow shaft and the hollow interior thereof.

4. The apparatus of claim 3 wherein said means for moving said plunger to the rearward end of said tube are comprised of:

said arrow including a hollow portion at the forward end thereof;

a hollow connecting member attached to the rearward end of said tube and removably attached to the forward end of said arrow; and said plunger being comprised of a piston member having an elongated rod attached thereto and extending through said hollow connecting member into said hollow portion of said arrow whereby said connecting member can be removed from said arrow and said rod moved rearwardly to move said piston member rearwardly within said tube.

5. The apparatus of claim 4 wherein said means for constantly urging said plunger towards the forward end of said tube comprises a spring disposed within said hollow portion of said arrow and positioned to contact the rearward end of said rod whereby when said connecting member is attached to said arrow, said spring urges said rod forwardly.

* * * * *